United States Patent [19]

Hill

[11] Patent Number: 4,726,786

[45] Date of Patent: Feb. 23, 1988

[54] DIRECT CURRENT BATTERY CONNECTOR

[76] Inventor: Jesse S. Hill, P.O. Box 12010, Florence, S.C. 29504

[21] Appl. No.: 840,388

[22] Filed: Mar. 17, 1986

[51] Int. Cl.[4] ..... H01R 11/00

[52] U.S. Cl. ..... 439/504

[58] Field of Search ..... 339/28, 29 R, 29 B

[56] References Cited

U.S. PATENT DOCUMENTS

| | | | |
|---|---|---|---|
| 3,293,443 | 12/1966 | Burch | 307/10 R |
| 3,343,057 | 9/1967 | Smith | 320/25 |
| 3,466,453 | 9/1969 | Greenberg | 339/29 B |
| 4,272,142 | 6/1981 | Zapf | 339/29 B |
| 4,366,430 | 12/1982 | Wright | 339/29 B |
| 4,420,212 | 12/1983 | Wright | 339/29 B |

*Primary Examiner*—Gil Weidenfeld
*Assistant Examiner*—Paula A. Austin
*Attorney, Agent, or Firm*—Bailey & Hardaway

[57] ABSTRACT

The direct current battery connector enables electrical interconnection of the battery on a conventional vehicle and the battery on a vehicle equipped with an electrical system including an electrical socket for receipt of the male electrical plug of the connector cable.

5 Claims, 2 Drawing Figures

DIRECT CURRENT BATTERY CONNECTOR

BACKGROUND OF THE INVENTION

This invention relates generally to the starting of a vehicle and more particularly to an electrical interconnection of a defective battery on one vehicle and a charged battery on another vehicle for starting purposes.

Various devices exist within the prior art for supplying power to a defective battery. One such device is disclosed in U.S. Pat. No. 3,343,057 to Smith which specifies a battery boosting apparatus used with a service vehicle whereby boost power is supplied by a combination of the service vehicle battery and an auxiliary battery and in which reverse-polarity protection is provided, indicated by an audible signal. Remote controls are provided for completing a booster current supply circuit to the jumper cables.

In U.S. Pat. No. 3,293,443 to Burch a power converter is disclosed, adaptable for attachment to a vehicle and having an electrical circuit which includes a battery, a generator, and a regulator.

Subsequently, the need for an improved electrical system for vehicles has been met by the invention disclosed in U.S. Pat. No. 3,466,453 to Greenberg. The disclosed system includes a receptacle unit mounted on a vehicle which is electrically connected to its associated battery, and an electrical connector cable to connect the receptacle units of interconnecting vehicles. The improved system is safe and convenient to use, necessitating only plugging the connector cable into the receptacle unit mounted on each vehicle in order to use the power of the vehicle having the charged battery to assist the vehicle having the defective battery.

It must be appreciated, however, that the improved system is appropriate and functional only when the two vehicles to be electrically interconnected are both equipped with the required receptacle unit. Although in recent years an increasing number of vehicles have become so equipped, most vehicles are not currently equipped with the improved electrical system and require conventional means of electrical interconnection. There is an obvious need, therefore, to develop a means of electrically interconnecting vehicles when one remains conventional and the other is equipped with the improved system. In addition, the safe working of such means must be assured.

SUMMARY OF THE INVENTION

It is thus an object of this invention to provide a direct current battery connector for use in interconnecting the defective battery of one vehicle and the charged battery of another vehicle in order to recharge the defective battery.

It is a further object of this invention to enable electrical interconnection of the battery on a conventional vehicle and the battery on a vehicle equipped with an electrical system including an electrical socket.

It is a still further object of this invention to provide an apparatus for electrically interconnecting vehicles which is intrinsically safe.

These as well as other objects are accomplished by a direct current battery connector comprising an electrical connector cable with a positive battery clamp and a negative battery clamp at one end and a male electrical plug at the other end and having a safety switch attached to the negative conductor wire of the cable near the male electrical plug.

DETAILED DESCRIPTION OF THE DRAWINGS

In accordance with this invention, it has been found that the direct current battery connector to be herein described may be used to interconnect the battery of a conventional vehicle and the battery of a vehicle equipped with an electrical system including an electrical socket for receiving the plug of a connector cable. The instant invention incorporates into its design the improved technology of electrical systems for vehicles such as that disclosed in U.S. Pat. No. 3,466,453 to Greenberg by including a male electrical plug at one end of its connector cable. In addition, as most vehicles are not currently equipped with such improved electrical systems, the instant invention provides a conventional set of battery clamps at the opposing end of its connector cable. Typically, the direct current battery connector is associated with and carried in a vehicle equipped with the referenced electrical system, enabling the connector cable to be plugged into the electrical socket mounted on such vehicle and to be clamped onto the battery of a second vehicle. Thus, the direct current battery connector is both progressive in design and practical in application, as well as convenient to use and to store.

In addition, the safety switch of the instant invention insures safe usage of the direct current battery connector. If a power surge should occur while the connector cable is in use, the switch will automatically and immediately break the electrical circuit thereby preventing any damage to person or vehicle. This invention will be further understood from the following description and reference to the various figures of drawing.

Figure 1:
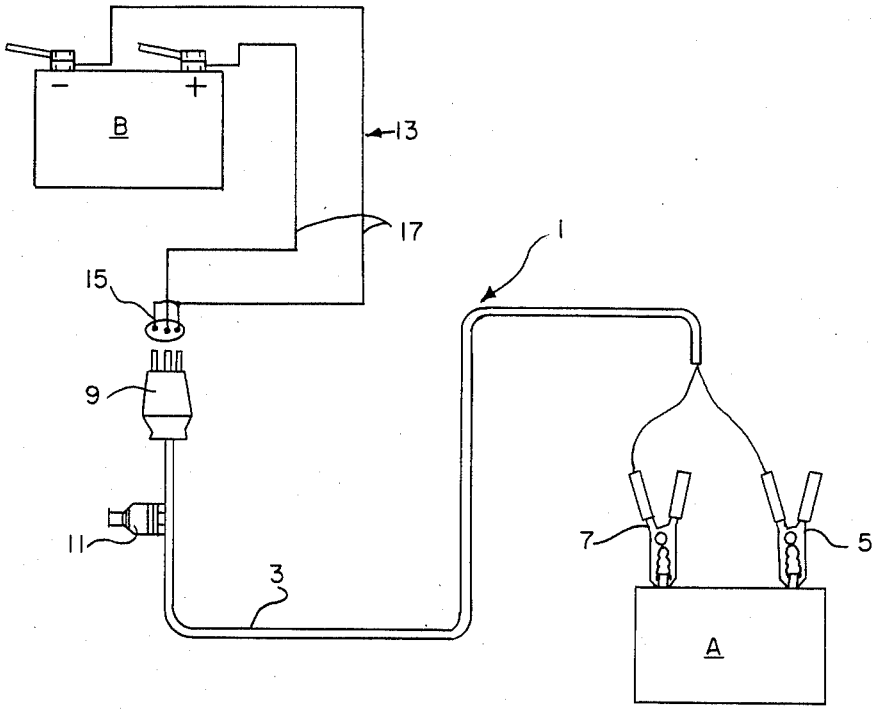
FIG. 1 is a schematic diagram of the apparatus in accordance with the invention showing the general construction thereof and illustrating the electrical interconnection of the battery on a conventional vehicle and the battery on a vehicle equipped with an improved electrical system.

FIG. 1 of the drawings illustrates an apparatus comprising an electrical connector cable 3 having a positive battery clamp 5 and a negative battery clamp 7 at one end and a male electrical plug 9 at the opposing end. A safety switch 11 is attached to the negative conductor wire of the cable 3.

For purposes of transmitting direct current power from a charged battery on a first vehicle to a defective battery on a second vehicle, apparatus 1 electrically interconnects battery A of a conventional vehicle and battery B of a vehicle equipped with an improved electrical system such as that disclosed in U.S. Pat. No. 3,466,453 to Greenberg and hereby incorporated by reference, including said system 13 comprising an electrical socket 15 and conductor means 17 electrically connecting the socket 15 to its associated battery B. The positive and negative battery clamps 5 and 7, respectively, attach directly to battery A of the conventional vehicle, and the male electrical plug 9 attaches to battery B of the vehicle equipped with the electrical system 13 by means of the electrical socket 15.

Figure 2:
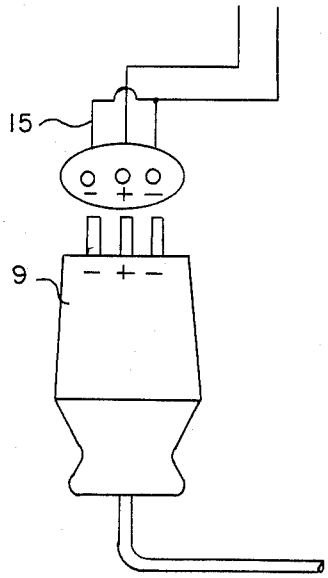
FIG. 2 is an enlarged view of the male electrical plug of the apparatus in accordance with the invention positioned opposite an electrical socket.

FIG. 2 illustrates an enlarged view of the male electrical plug 9 of the apparatus 1 properly aligned opposite the electrical socket 15 of the associated electrical system 13. The unique configuration of the plug makes incorrect alignment with and insertion into the electrical socket 15 impossible, thereby providing assurance of proper usage of apparatus.

FIG. 1 of the drawings further illustrates a safety switch 11 attached to the negative conductor wire of the cable 3 and located near the male electrical plug 9. The safety switch is a conventional circuit breaker which breaks the electrical circuit of cable 3 and electrical system 13 upon reverse polarity, thereby providing further assurance of proper usage of apparatus 1.

As variations of the apparatus of this invention will be apparent to one of skill in the art from a reading of the above specification, such variations are within the spirit and scope of this invention as defined by the following appended claims.

That which is claimed is:

1. A direct current battery connector comprising:

a single electrical connector cable having a conductor for positive battery connection and a conductor for negative battery connection;

a positive battery clamp and a negative battery clamp at one end of said cable each communicating with the conductor of said cable of similar polarity;

a male electrical plug at the opposing end of said cable having positive and negative connections therein; and a safety switch which automatically breaks current flow when necessary attached to the negative conductor wire of said cable.

2. The direct current battery connector according to claim 1 wherein said positive and negative battery clamps attach directly to said battery of said conventional vehicle.

3. The direct current battery connector according to claim 1 wherein said safety switch is attached to the negative conductor wire of said cable near said male electrical plug and is a conventional circuit breaker that breaks upon reverse polarity.

4. The direct current battery connector according to claim 1 wherein said electrical connector cable electrically interconnects the battery of a conventional vehicle to the battery of a vehicle equipped with an electrical system having a receptacle unit comprising a compatible female electrical plug and conductor means.

5. The direct current battery connector according to claim 4 wherein said male electrical plug attached to said vehicle equipped with said electrical system by means of mating with said electrical socket mounted on said vehicle.

* * * * *